US006742754B1

(12) United States Patent
Maier-Hunke et al.

(10) Patent No.: US 6,742,754 B1
(45) Date of Patent: Jun. 1, 2004

(54) BRACKET FOR TURNABLE BOARDS OR SIMILAR

(75) Inventors: Horst-Werner Maier-Hunke, Iserlohn (DE); Rainer Dzillum, Bergkamen-Oberaden (DE)

(73) Assignee: "Durable" Hunke & Jochheim GmbH & Co. KG, Iserlohn (DE)

( * ) Notice: Subject to any disclaimer, the term of this patent is extended or adjusted under 35 U.S.C. 154(b) by 0 days.

(21) Appl. No.: 10/129,582

(22) PCT Filed: Nov. 8, 2000

(86) PCT No.: PCT/DE00/03960

§ 371 (c)(1),
(2), (4) Date: May 3, 2002

(87) PCT Pub. No.: WO01/34000

PCT Pub. Date: May 17, 2001

(30) Foreign Application Priority Data

Nov. 10, 1999 (DE) ..... 199 55 376

(51) Int. Cl.[7] ..... A47B 19/00
(52) U.S. Cl. ..... 248/441.1; 40/510; 248/447.1
(58) Field of Search ..... 248/441.1, 163.1, 248/454, 444.9, 371, 397, 447.1; 40/661, 532, 492, 536, 510; 211/47, 169

(56) References Cited

U.S. PATENT DOCUMENTS

| | | | | | |
|---|---|---|---|---|---|
| 2,447,460 | A | | 8/1948 | Forsyth | |
| 3,514,883 | A | * | 6/1970 | Albright | 40/492 |
| 5,833,082 | A | * | 11/1998 | Barthel | 211/47 |
| D417,805 | S | * | 12/1999 | Bramsiepe et al. | D6/509 |
| 6,176,029 | B1 | * | 1/2001 | Maier-Hunke | 40/661 |
| 6,199,815 | B1 | | 3/2001 | Maier-Hunke | 248/454 |
| D442,404 | S | * | 5/2001 | Bramsiepe et al. | D6/509 |
| 6,234,707 | B1 | * | 5/2001 | Maier-Hunke | 403/331 |
| 6,250,598 | B1 | * | 6/2001 | Maier-Hunke | 248/441.1 |
| 6,491,171 | B2 | * | 12/2002 | Maier-Hunke | 211/47 |

FOREIGN PATENT DOCUMENTS

| | | |
|---|---|---|
| DE | 85133 | 4/1895 |
| DE | 196 23 895 | 12/1997 |
| DE | 297 20 255 | 4/1998 |
| DE | 197 03 754 | 8/1998 |

OTHER PUBLICATIONS

SHERPA Display Panel System Catalog (no date).*

* cited by examiner

*Primary Examiner*—Ramon O. Ramirez
(74) *Attorney, Agent, or Firm*—Mark P. Stone

(57) ABSTRACT

The invention relates to a bracket for turnable boards, whereby the base body (1) of the bracket together with the cross beam (10) of a support rod (8) form a support for the bracket, the base body of which, itself, is connected to the support rod (8) by means of a gapping piece (7).

20 Claims, 1 Drawing Sheet

BRACKET FOR TURNABLE BOARDS OR SIMILAR

TECHNICAL FIELD

The invention relates to a holder for turnable panels and/or turnable pockets or casings, having a basic body which has a mount for a retaining section of a retaining rod.

1. Prior Art

The holder of the abovementioned type is known from DE 196 23 895 C2. In the case of the known holder, the retaining rod is formed by a rectilinear column which either is provided with a foot, which is more or less heavy in order to achieve sufficient stability, or can be fastened on a table top by a clamping device. The production outlay required by a stand comprising a column and a foot, as well as the production outlay for a clamping device, is comparatively high. Added to this is the fact that the known holder requires additional means if it is to be positioned in an oblique manner in order for it to be easier to use.

In order for it to be possible to utilize a holder of the type in question as an obliquely positioned table-top holder, DE 197 03 754 C2 has proposed using a stand which comprises in each case two side parts and at least one intermediate part connected releasably thereto, the intermediate part having a mount for the basic body of the holder. The known stand provides the advantage that its width can easily be varied by using a greater or lesser number of intermediate parts, and can thus be adapted to the number of turnable panels or the like which are to be accommodated. However, on account of its multipart construction and of the form of its individual parts, this stand is also expensive.

2. Description of the Invention

The object of the invention is to design a holder of the generic type in question such that, by way of straightforward means, it can be utilized as a table-top holder. This object is achieved according to the invention in that the retaining section of the retaining rod merges into a further section, which encloses an angle with said section, and in that that end of the further section which is directed away from the retaining section is connected to a transverse rod, which counteracts tilting movements of the holder around the longitudinal axis of the further section and of which the ends, together with the bottom end of the basic body, form the holder support.

The holder according to the invention is distinguished by a straightforward and inexpensive construction, which allows for it to be mass-produced. Using it proves to be expedient whenever the number of corresponding turnable panels or the like are kept within narrow limits.

BRIEF DESCRIPTION OF THE DRAWINGS

Further details and features of the invention can be gathered from the subclaims and from the following description of a particularly advantageous embodiment illustrated in the attached drawing, in which:

METHODS OF IMPLEMENTING THE INVENTION

Figures 1, 2, 3:
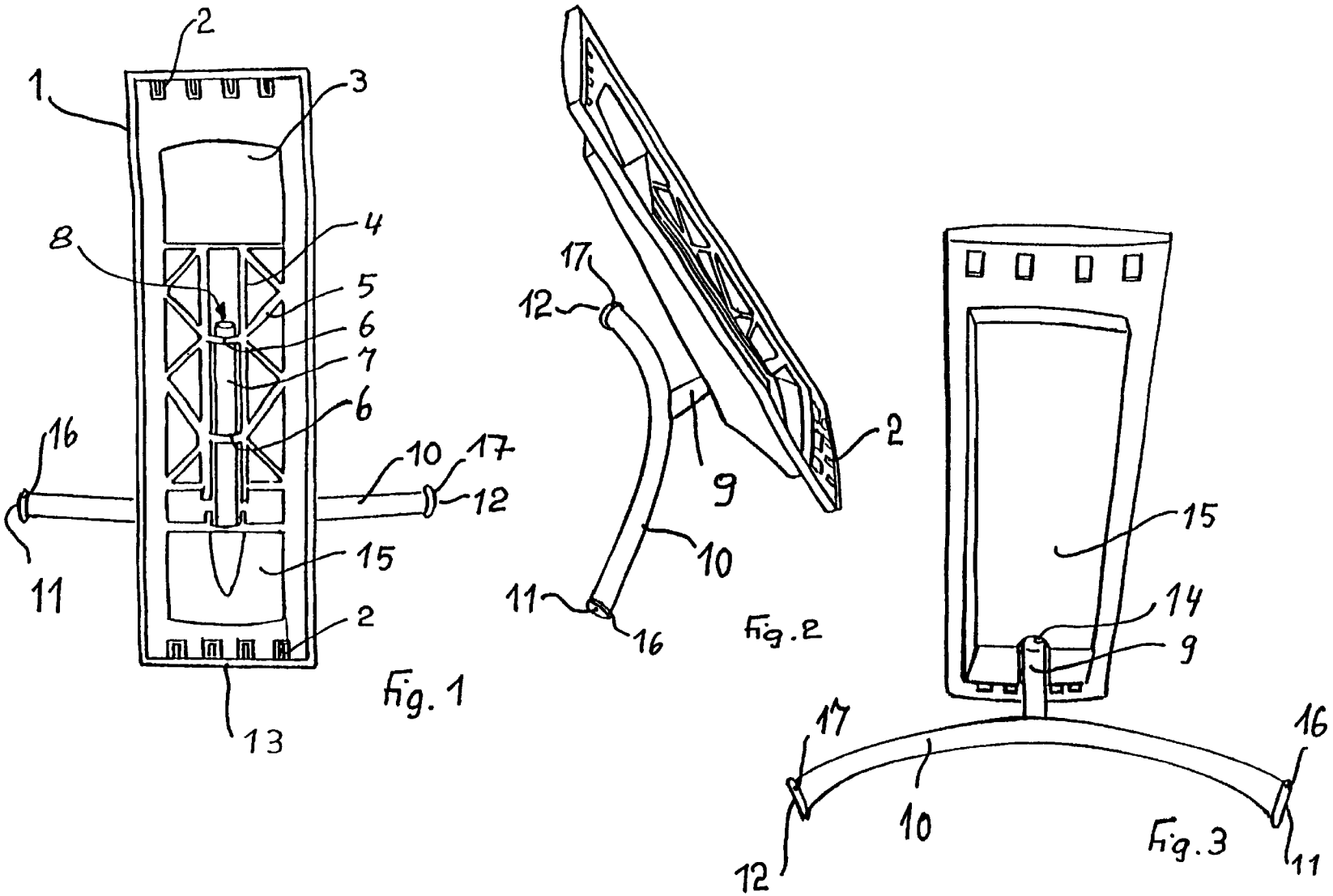
FIG. 1 shows the front view of a holder.
FIG. 2 shows the side view of the holder according to FIG. 1.
FIG. 3 shows the rear view of the holder according to FIGS. 1 and 2.

The holder illustrated in the figures has a basic body 1 with pins 2 arranged at its top and bottom ends, these pins forming pivot bearings for swivel panels of a known type. Located in the central part of the basic body 1 is a cavity 3 which, in order to increase the rigidity of the holder, is provided with longitudinal struts 4 and transverse struts 5 and 6. Two transverse struts 6 are connected to aligned plug-through openings for the retaining section 7 of a retaining rod 8. The retaining section 7 of the retaining rod 8 is adjoined, approximately at right angles, by a section 9, of which the end which is directed away from the retaining section 7 is connected to a transverse rod 10 of sickle-shape and design. The ends 11, 12 of the transverse rod 10, together with the bottom end 13 of the basic body 1, form a kind of three-point support for the holder. In the region of the transition between the sections 7 and 9, the retaining rod 8 is flattened slightly. The flattening results in the width of the retaining rod 8 increasing. This widening is utilized in order to achieve a clamping effect between the retaining rod 8 and the introduction opening 14 provided for it in the base 15 of the cavity 3. In order to counteract undesirably easy displacibility of the holder on the respective surface on which it is set up, the ends 11, 12 of the transverse rod 10 are provided with O-rings 16 and 17 retained in grooves.

The abovedescribed design of the retaining rod 8, which merges into the transverse rod 10, increase the possible uses of the abovedescribed basic body 1, which is part of a system of which the versatility can be gathered from the documents mentioned in the introduction.

What is claimed is:

1. A holder for turnable panels and/or turnable pockets or casings, having a basic body (1) which has a mount for a retaining section (7) of a retaining rod (8) which can be connected releasably to the basic body, characterized in that the retaining section (7) of the retaining rod (8) merges into a further section (9), which encloses an angle with said section (7), and in that the end of the further section (9) which is directed away from the retaining section (7) is connected to a transverse rod (10), which counteracts tilting movement of the holder around the longitudinal axis of the further section (9) and of which the ends (11, 12), together with the bottom end (13) of the basic body (1), form the holder support.

2. The holder as claimed in claim 1, characterized in that the retaining section (7) of the retaining rod (8) is guided in at least two aligned plug-through openings of the basic body (1) in a position in which its longitudinal axis runs parallel to the longitudinal axes of pivot pins (2) arranged in the basic body (1).

3. The holder as claimed in claim 2, characterized in that the plug-through openings are arranged in tranverse struts (6) which serve for reinforcing a central cavity (3) of the basic body (1), and in that the base (15) of the cavity (3), said base forming part of the a rear wall of the basic body (1), is provided with an introduction opening (14) for the retaining section (7) of the retaining rod (8).

4. The holder as claimed in claim 3, characterized in that side borders of the introduction opening (14) form clamping side pieces which secure the position of the retaining section (7) of the retaining rod (8) in the plug-through openings.

5. The holder as claimed in claim 4, characterized in that the retaining rod (8) is formed by a tube which is flattened in the region of the transition between the first and second sections of the retaining rod.

6. The holder as claimed in claim 4, characterized in that the transverse rod (10) is of sickle-shaped design.

7. The holder as claimed in claim 4, characterized in that O-rings (16, 17) retained in grooves at the ends (11) of the transverse rod (10) form two points of the three-point support.

8. The holder as claimed in claim 4, characterized in that the transverse rod (10) is in the form of a solid steel rod.

9. The holder as claimed in claim 3, characterized in that the retaining rod (8) is formed by a tube which is flattened in the region of the transition between the first and second sections of the retaining rod.

10. The holder as claimed in claim 3, characterized in that the transverse rod (10) is of sickle-shaped design.

11. The holder as claimed in claim 3, characterized in that O-rings (16, 17) retained in grooves at the ends (11) of the transverse rod (10) form two points of the three-point support.

12. The holder as claimed in claim 3, characterized in that the transverse rod (10) is in the form of a solid steel rod.

13. The holder as claimed in claim 1, characterized in that the retaining rod (8) is formed by a tube which is flattened in the region of the transition between the first and second sections of the retaining rod.

14. The holder as claimed in claim 1, characterized in that the transverse rod (10) is of sickle-shaped design.

15. The holder as claimed in claim 1, characterized in that O-rings (16, 17) retained in grooves at the ends (11) of the transverse rod (10) form two points of the three-point support.

16. The holder as claimed in claim 1, characterized in that the transverse rod (10) is in the form of a solid steel rod.

17. The holder as claimed in claim 2, characterized in that the retaining rod (8) is formed by a tube which is flattened in the region of the transition between the first and second sections of the retaining rod.

18. The holder as claimed in claim 2, characterized in that the transverse rod (10) is of sickle-shaped design.

19. The holder as claimed in claim 2, characterized in that O-rings (16, 17) retained in grooves at the ends (11) of the transverse rod (10) form two points of the three-point support.

20. The holder as claimed in claim 2, characterized in that the transverse rod (10) is in the form of a solid steel rod.

* * * * *

UNITED STATES PATENT AND TRADEMARK OFFICE

CERTIFICATE OF CORRECTION

PATENT NO. : 6,742,754 B1
DATED : June 1, 2004
INVENTOR(S) : Horst-Werner and Maier-Hunke et al.

It is certified that error appears in the above-identified patent and that said Letters Patent is hereby corrected as shown below:

Column 1,
Line 10, delete "The" (first occurrence), and substitute -- A --.
Line 40, delete "that" (second occurrence), and substitute -- the --.
Line 65, Add the following paragraph:

The disclosure of the following United States Patents are incorporated herein by reference as generally illustrating the knowledge of persons skilled in the relevant art: U.S. Patent No. 6,491,171 (corresponding to DE 197 03 754 referred to above); U.S. Patent No. 6,199,815; and U.S. Patent No. 6,176,029.

Signed and Sealed this

Twentieth Day of July, 2004

JON W. DUDAS
*Acting Director of the United States Patent and Trademark Office*